US005564204A

United States Patent [19]

Cagliari et al.

[11] Patent Number: 5,564,204

[45] Date of Patent: Oct. 15, 1996

[54] SKI BOOT WITH A POLE-ACTIVATED STOP RELEASE

[75] Inventors: Cesare Cagliari, Bigolino, Italy; Antoine Volanis, Paris, France

[73] Assignee: Lange International S.A., Fribourg, Switzerland

[21] Appl. No.: 459,487

[22] Filed: Jun. 2, 1995

[30] Foreign Application Priority Data

Jul. 1, 1994 [CH] Switzerland ..... 2 110/94

[51] Int. Cl.[6] ..... A43B 5/04; A43B 5/16

[52] U.S. Cl. ..... 36/118.7; 36/118.2

[58] Field of Search ..... 36/117–121, 109, 36/50.5

[56] References Cited

U.S. PATENT DOCUMENTS

| | | | |
|---|---|---|---|
| 4,499,676 | 1/1985 | Chalmers . | |
| 4,761,899 | 8/1988 | Marxer | 36/121 |
| 5,001,849 | 3/1991 | Bidoia | 36/117 |
| 5,065,533 | 11/1991 | Paris | 36/120 |
| 5,136,794 | 8/1992 | Stampacchia et al. | 36/117 |

FOREIGN PATENT DOCUMENTS

| | | |
|---|---|---|
| 0375604 | 2/1990 | European Pat. Off. . |
| 2619317 | 2/1989 | France . |
| 3201702 | 9/1982 | Germany . |
| WO9312683 | 8/1993 | WIPO . |

*Primary Examiner*—B. Dayoan

*Attorney, Agent, or Firm*—Kane, Dalsimer, Sullivan, Kurucz, Levy, Eisele and Richard, LLP

[57] ABSTRACT

Ski boot having a lower part (1) and a shaft (4, 12) articulated on the lower part and including, at the rear, a movable stop (15) mounted on one of the parts of the boot and interacting with a fixed stop (20) mounted on the other part of the boot to hold the shaft in downhill position, inclined towards the front. The movable stop (20) is equipped with an arm (22) passing through the shaft of the boot on its external side so as to be capable of being actuated by a pole.

9 Claims, 6 Drawing Sheets

SKI BOOT WITH A POLE-ACTIVATED STOP RELEASE

FIELD OF THE INVENTION

The present invention relates to a ski boot constituted by a lower part surrounding the foot and the heel and by a shaft articulated on the lower part, and comprising, at the rear, a first stop mounted on the lower part of the boot and interacting with a second stop mounted on the shaft of the boot to hold the shaft in downhill position, inclined towards the front, one of these stops being mounted movably so as to allow restraightening and oscillation of the shaft on the lower part.

PRIOR ART

From the U.S. Pat. No. 3,543,421, a boot is known, the shaft of which, articulated on a shell, is equipped with an adjustable stop interacting with a stop fixed to the shell.

From the U.S. Pat. No. 4,499,676 in the name of the applicant, a boot is known, the shaft of which is equipped with a rocker with a spring, the lower arm of which comes to butt against a stop fixed on the shell. Pressure on the upper arm of the rocker makes it possible to free the shaft.

The patent FR 2 619 317 likewise describes a boot, the shaft of which is equipped with a rocker, it being possible to free the shaft of the boot simultaneously with the opening of a clamping lever mounted at the rear of the boot and acting in the manner of a cam on the upper arm of the rocker.

It is likewise known to act on the upper arm of the rocker by means of a cam actuated by a rotary button or by a push-button mounted at the rear of the boot.

In all cases, the skier has to bend down to free the shaft in order to be able to restraighten the leg and adopt the rest or walking position. This freeing of the shaft is most frequently desired in a queue for a ski-lift and in such a queue it is inconvenient, even dangerous, to bend down or to crouch.

SUMMARY OF THE INVENTION

The aim of the present invention is to allow freeing of the shaft without bending down, that is to say by using a ski pole. To this end, the skier has to be able to press with his pole on an easily accessible member without necessitating contortions on the part of the skier.

The aim of the present invention is to produce a boot which satisfies the above requirements.

The boot according to the invention is characterized in that the movable stop is equipped with an arm passing through the boot on its external side so as to be capable of being actuated by essentially vertical pressure exerted by a pole.

The shaft of the boot can be in the form of a one-piece collar, such as described in the French patent 2 661 076, or in the form of a two-piece reconstituted collar such as described in French patent 2 673 081 (U.S. Pat. No. 5,243, 774) or even in the form of a collar which is indented at the rear for broad tilting and an auxiliary cap such as are described in European patents 0 286 586 and U.S. Pat. No. 4,839,973.

According to the embodiments, the arm is rigidly integral with the movable stop or articulated on the movable stop.

The movable stop can be mounted either on the shaft or on the lower part of the boot.

BRIEF DESCRIPTION OF THE DRAWINGS

The attached drawing represents, by way of example, a few embodiments of the invention.

DESCRIPTION OF THE PREFERRED EMBODIMENTS

Figure 1:
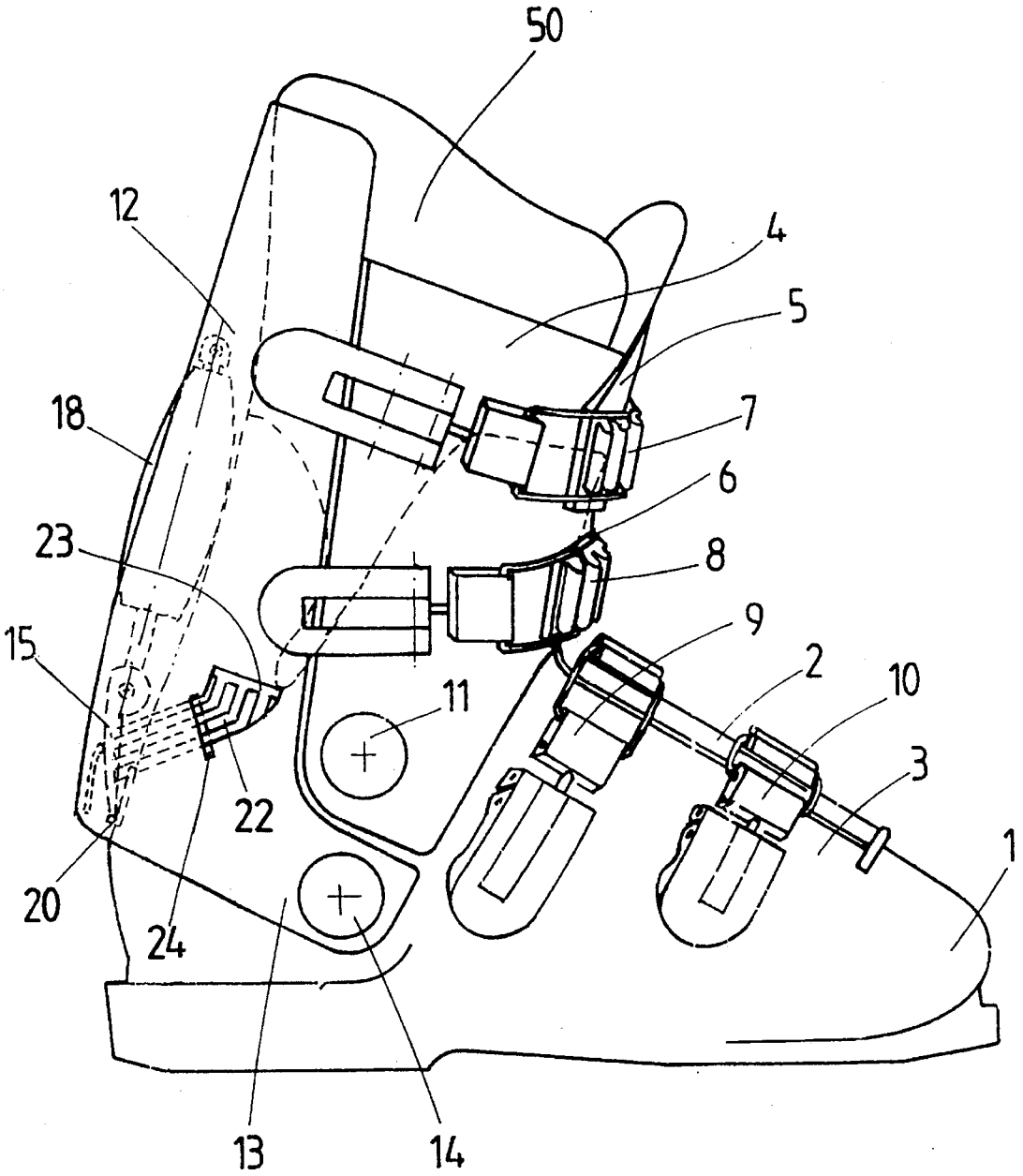
FIG. 1 represents a right boot in closed position and shaft retained in downhill position according to a first embodiment.

The boot represented in FIGS. 1 to 8 is a boot with a reconstituted collar, in two parts, of the same type as the boot described in French patent 2 673 081 (U.S. Pat. No. 5,243, 774). The boot comprises a lower part constituted by a shell 1 of variable volume surrounding the foot and the heel and closing on the foot via two flaps 2 and 3 equipped with two clamping buckles 9 and 10, and by a shaft constituted by a collar 4 surrounding the rear of the lower leg via a relatively narrow bridge equipped at the front with two flaps 5 and 6 and clamping buckles 7 and 8. The collar 4 is articulated on the shell 1 by means of two opposite rivets such as the rivet 11. The shaft of the boot is completed by a back part 12 extending over the entire length of the shaft and having the general shape of a gutter equipped in its lower part with two lateral arms 13 via which the part 12 is articulated on the shell at two opposite points by means of two rivets such as the rivet 14, situated below the rivet 11 and the rivet opposite the latter. The joining of the parts 4 and 12 of the shaft in closed position such as represented in FIG. 1 can be brought about for example as described in patent application CH 717/94. An inner comfort boot 50 can also be seen.

In the first embodiment represented in FIGS. 1 to 4, the back part 12 of the shaft is equipped internally with a movable stop 15 constituted by an elongate piece articulated in its upper part about an axis 16 at the end of a rod 17 which is integral with a connection piece 18, the other end of which is articulated at a point 19 in the upper half of the back part 12 of the shaft. The piece 18 is a threaded sleeve playing the role of a nut for the rod 17 and making it possible, by being driven rotationally, to modify the distance between the axes 16 and 19 and thus the inclination of the shaft. Such a device is described in particular in the U.S. Pat. No. 4,839,973. The sleeve 18 may also contain an elastic damping device such as described in the U.S. Pat. No. 4,932,143.

The movable stop 15 interacts with a fixed stop 20 constituted by a small elbowed plate fixed to the shell 1. The movable stop 15 is held bearing against this small plate by a leaf spring 21 working between the movable stop 15 and the internal wall of the part 12 of the shaft. The movable stop 15 is equipped with a lateral arm 22 made in one piece with the stop and having at its end a plate 23. The arm 22 passes through the back part 12 of the shaft via a slot 24 so that the plate 23 is situated on the outside of the boot, on the external side of the latter. The slot 24 permits a slight displacement downwards of the arm 22, which is just sufficient to allow the movable stop 15 to move away from the fixed stop 20 by pivoting about its axis 16.

Figure 2:
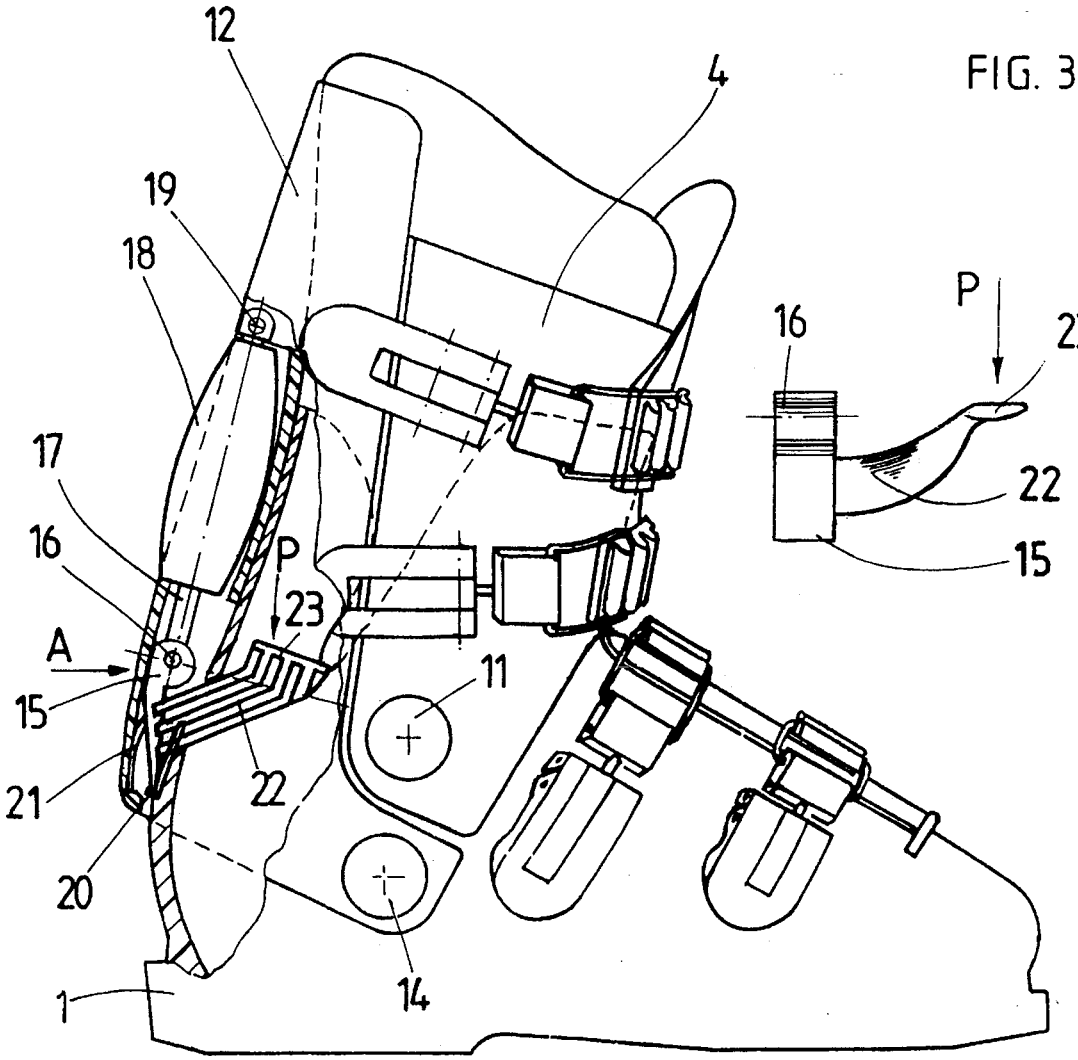
FIG. 2 is a view partially in longitudinal vertical section of the boot represented in FIG. 1.
Figure 3:
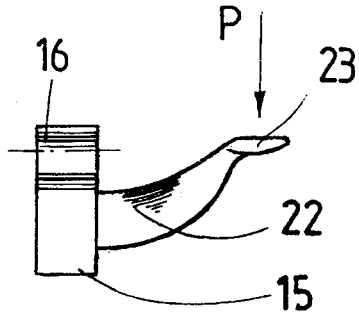
FIG. 3 is a view in direction A of the control arm of the movable stop of this first embodiment.
Figure 4:
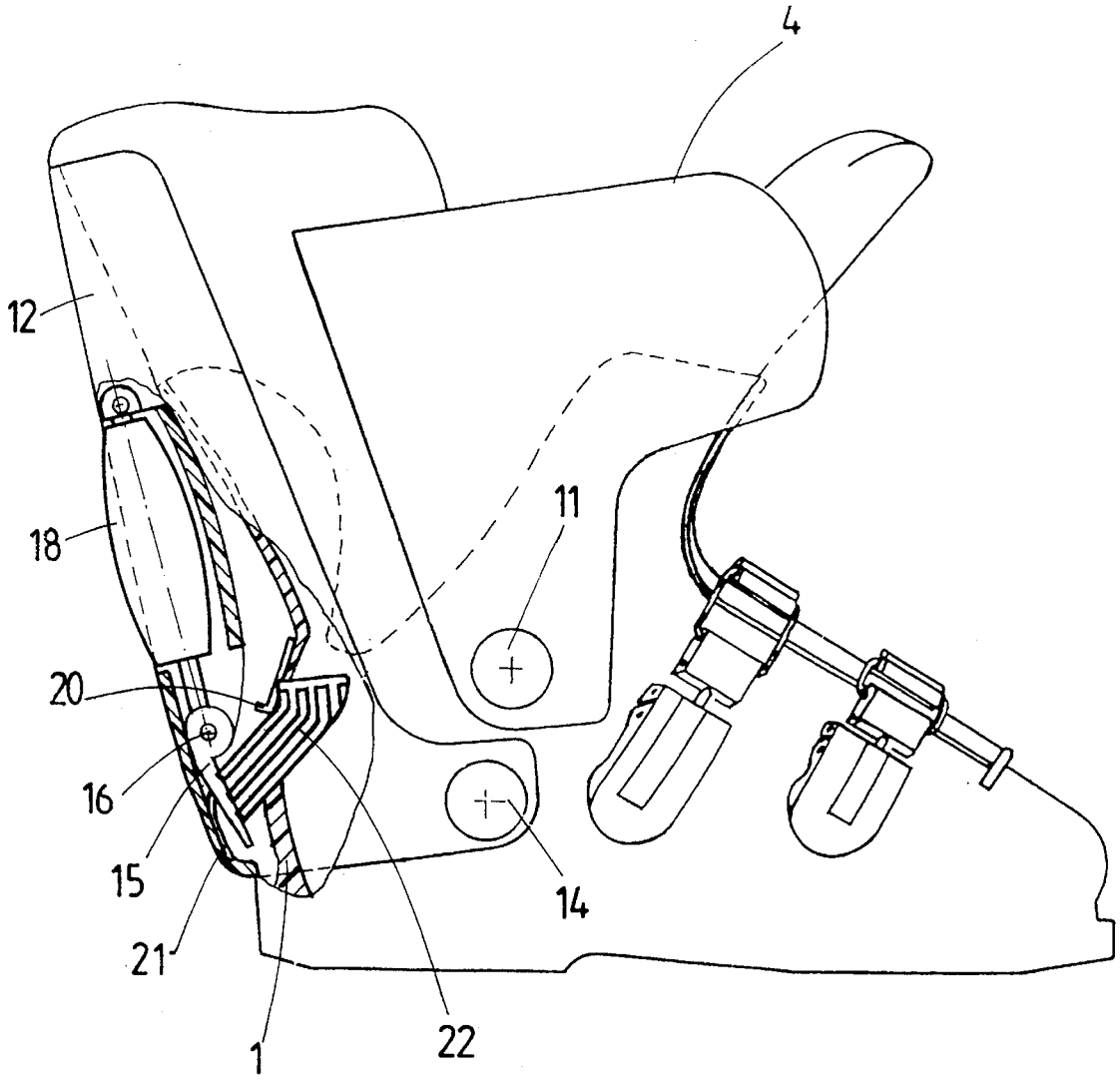
FIG. 4 is a view in partial section similar to that of FIG. 2 representing the same boot in open position, shaft freed.

In the locked position of the shaft represented in FIG. 2, when the skier wishes to free the shaft of the boot to restraighten the leg, he has only to exert by means of his pole a pressure P on the plate 23 which has the effect of making the movable stop 15 pivot. From this freed position of the shaft, the boot can likewise be opened as represented in FIG. 4 by tilting its back part 12 rearwards. Rotation of the movable stop 15 in the direction of the shell 1 is limited by the upper end of the slot 24 against which the arm 22 of the movable stop comes to butt.

The boot according to the second embodiment, represented in FIGS. 5 to 8, comprises a movable stop 25 constituted by a small plate articulated by its upper end by means of an axis 26 directly on the back part 12 of the shaft. Fixed on the internal wall of the part 12 of the shaft is a leaf spring 27 which tends to push the movable stop 25 against the fixed stop 20. Articulated at an intermediate point of the movable stop 25 is an elbowed arm 28 having a part **28*a* essentially parallel to the axis of the shaft of the boot and via which the rod 28 can be actuated by means of a push-button 29 mounted in an oblong housing 30 constituted by a depression formed in the external wall of the back part 12 of the shaft. The rod 28 therefore constitutes a sort of elbowed link. The lower part of the housing 30 has a lip 31 in which an annular piece 32 (FIG. 6) is fixed, which is equipped internally with ribs 33 and in which a bearing piece 34 can slide, the center of which is in the form of a bowl in which the end of the elbowed arm 28** comes to engage.

Figures 5, 6:
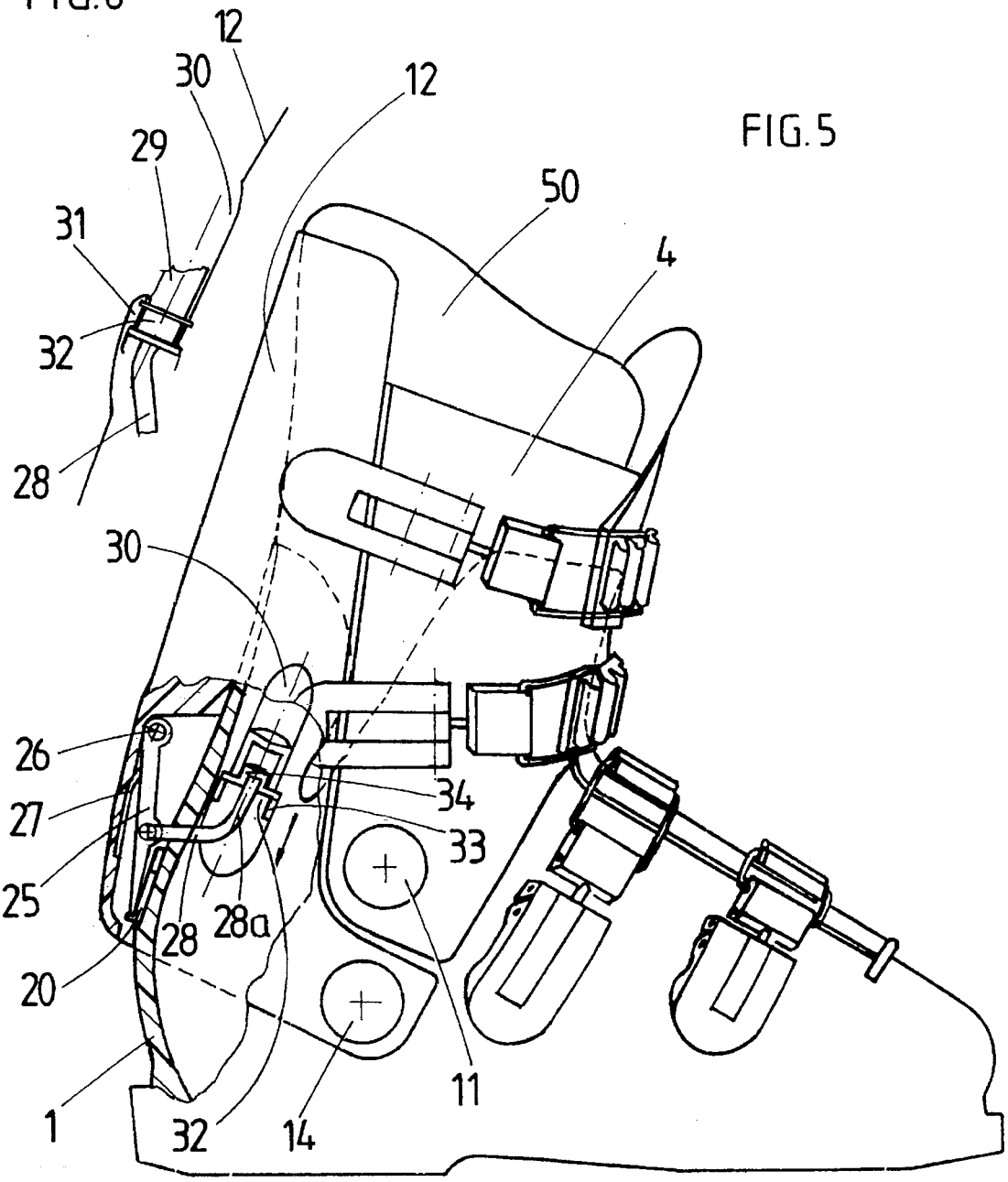
FIG. 5 represents a second embodiment in downhill position, according to a view similar to that of FIG. 2.
FIG. 6 is a detailed view, in direction A, of the control push-button of the boot represented in FIG. 5.
Figure 7:
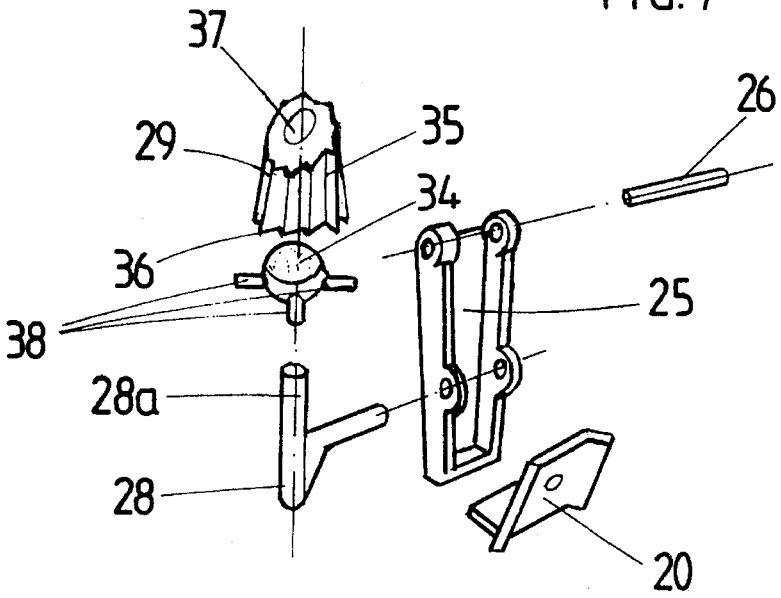
FIG. 7 represents an exploded view of the control means of the movable stop of this second embodiment.

The push-button 29 is a bistable push-button of the type used in certain ballpoint pens. The components of this push-button are represented in the exploded view in FIG. 7. The push-button 29 has on the one hand longitudinal ribs 35 engaged in ribs of the annular piece 32 so that the push-button 29 is prevented from turning about its axis. The push-button 29 is in the form of an inverted bush, the lower edge of which is equipped with a toothing made of ratchet teeth 36. The upper end of the push-button 29 has a depression 37 intended to retain laterally the tip of the ski pole used for pressing the push-button. The bearing piece 34 is equipped with four radial arms 38 engaged in the grooves 33 of the annular piece 32 and capable of sliding in these grooves. In a manner known per se, the grooves 33 are alternately short and long and limited by a stop wall limiting the longitudinal displacement of the radial arms 38 of the bearing piece in the grooves. The width of the teeth of the ratchet toothing 36 is such that when the push-button 29 is pressed, the inclines of the teeth 36, which come to bear on the radial arms 38 of the bearing piece, tend to drive the bearing piece rotationally so that when the radial arms 38 escape from the grooves 33, the bearing piece turns by one turn and each of its arms passes from one groove to the following groove, that is to say from a long groove to a short groove, then from a short to a long groove and so on. FIG. 5 represents the bearing piece 34 at the bottom of the long grooves. In this position, the movable stop 25 can come to catch on the fixed stop 20, locking the shaft.

Figure 8:
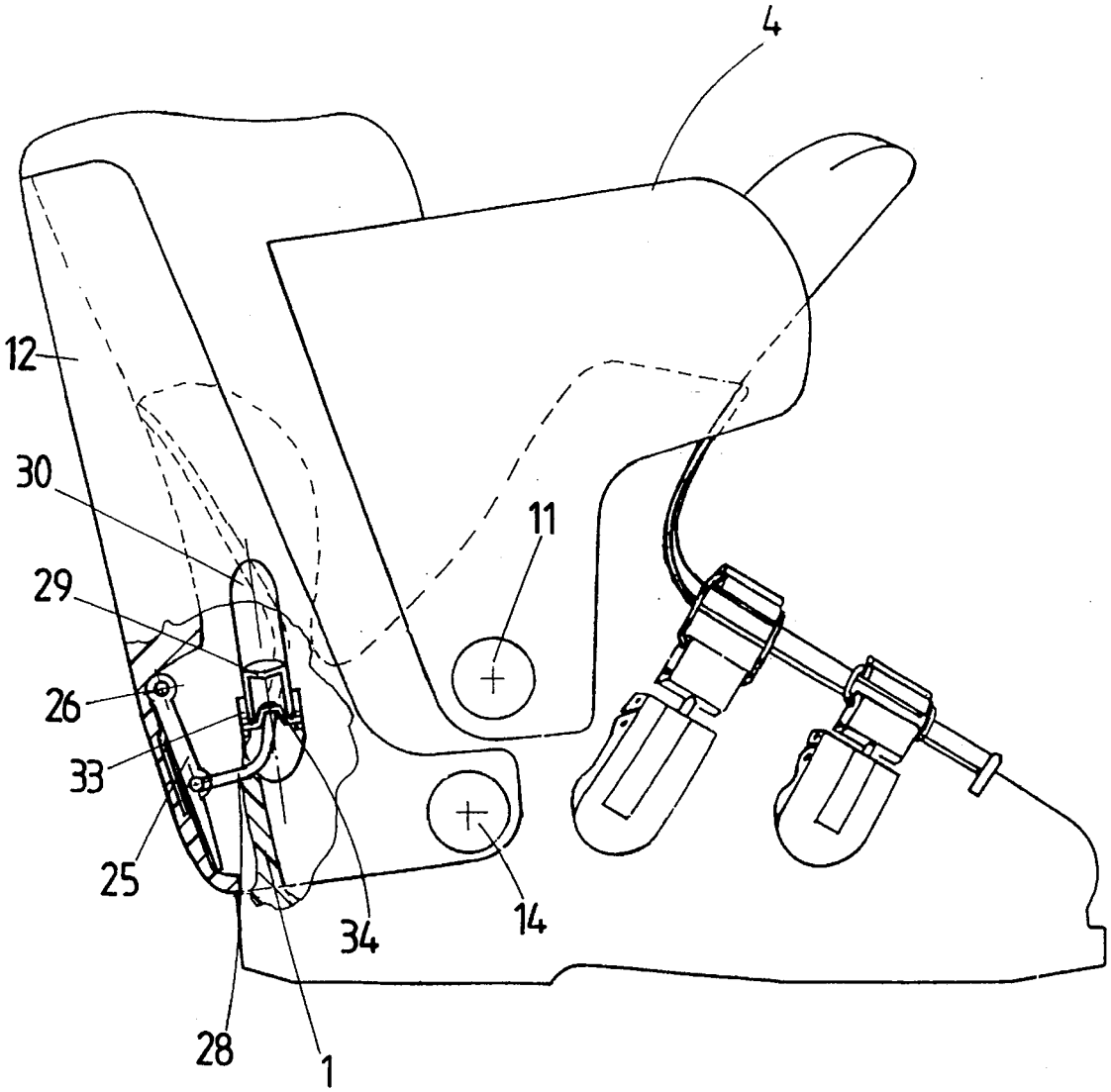
FIG. 8 represents the second embodiment in the freed position of the shaft.

Pressure by means of the ski pole on the push-button 29 has the effect of making the radial arms 38 pass from the bearing piece 34 into the short grooves, as FIG. 8 represents. The arms 28, driven by the bearing piece 34, then move the movable stop 25 away from the fixed stop 20, making it possible to restraighten the shaft of the boot and to make its back part 12 tilt for the opening of the boot as represented in FIG. 8. As the push-button 29 is bistable, the movable stop 25 remains in the position represented in FIG. 8 until there is renewed pressure on the push-button 29. The spring of the bistable push-button 29 is constituted by the spring 27 of the movable stop.

The hollow 30 constitutes simultaneously a guide for the end of the pole on the push-button.

Figure 9:
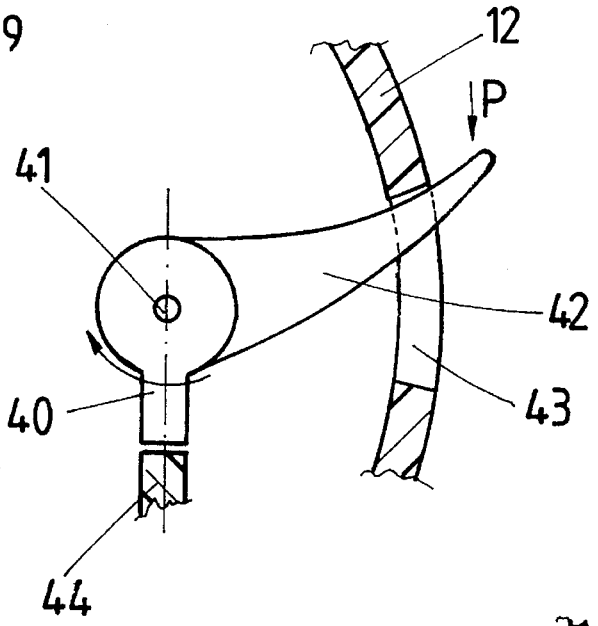
FIG. 9 is a partial view of a third embodiment.

FIG. 9 represents partially a third embodiment consisting of a movable stop 40 mounted rotatably about an axis 41 perpendicular to the wall of the back part 12 of the shaft of the boot and equipped with an arm 42 passing through an essentially vertical slot 43 formed in the part 12 of the shaft so that pressure P on the end of the arm 42 makes the movable stop 40 pivot so as to move the latter away from a fixed stop 44 integral with the shell 1 of the boot. The return of the movable stop 40 into the position represented can be carried out by a spring, such as a hunting-horn-shaped spring or a leaf spring.

Figure 10:
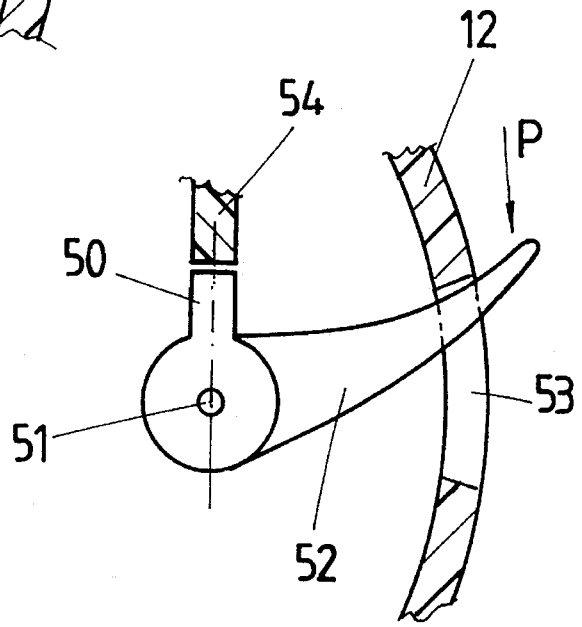
FIG. 10 is a partial view of a fourth embodiment.

The movable stop does not necessarily have to be on the shaft of the boot. FIG. 10 represents diagrammatically a fourth embodiment obtained by reversal of the preceding embodiment. It is constituted by a movable stop 50 articulated on the shell 1 about an axis 51 perpendicular to the shell and equipped with an arm 52 passing through the back part 12 of the shaft via a slot 53. Pressure P on the end of the arm 52 has the effect of making the movable stop 50 pivot and of moving it away from a fixed stop 54 integral with the part 12 of the shaft.

The bistable push-button 29 could of course be replaced by any other embodiments of bistable buttons, for example push-buttons of switches such as are used in certain electrical installations.

The movable stop could likewise be sliding and displaceable transversely to the boot. It could consist of a retractable stop of the type represented in the patent EP 0 375 604.

We claim:

1. A ski boot having an internal and external side and a front and rear, and comprising a lower part (1) surrounding a foot and a heel of a skier and a shaft (4,12) articulated on the lower part, said boot further comprising, at the rear, a first stop (20; 44; 50) fixedly mounted on the lower part (1) of the boot and a second stop (15; 25; 40; 50), interacting with said first stop, mounted on the shaft of the boot to hold the shaft in downhill position, inclined towards the front, the second stop being mounted movably so as to allow restraightening and oscillation of the shaft on the lower part (1) of the boot, the second movable stop (15; 25; 40; 50) is equipped with an arm (22; 28; 42; 52) passing through the shaft of the boot on the external side thereof, so as to be capable of being actuated by pressure exerted thereon by a pole.

2. The ski boot as claimed in claim 1, wherein the arm (22; 42; 52) is rigidly integral with the movable stop.

3. The ski boot as claimed in claim 2, wherein the movable stop (15; 25) is articulated about a horizontal axis transverse to the boot.

4. The ski boot as claimed in claim 2, wherein said shaft has a back wall and wherein the second movable stop (40; 50) is mounted rotatably about an axis essentially perpendicular to the wall of the shaft or of the lower part of the boot.

5. The ski boot as claimed in claim 4, wherein the movable stop (40) is mounted on the shaft of the boot.

6. The ski boot as claimed in claim 4, wherein the movable stop (50) is mounted on the lower part (1) of the boot.

7. The ski boot as claimed in claim 1, wherein the movable stop (25) is articulated on the shaft (12) about a horizontal axis transverse to the boot and wherein said arm (28) is an elbowed arm articulated on the movable stop and actuable by a bistable push-button (29) holding the second movable stop out of the trajectory of the fixed stop (20) in one of the movable stop's stable positions.

8. The ski boot as claimed in claim 7, wherein the movable stop (25) is pushed by a spring (27) in the direction of the lower part of the boot and wherein the arm (28) articulated to the movable stop is a link, the end of which bears, under the thrust of the spring, in a depression in the form of a bowl of a bearing piece (34) of the push-button (29), this bearing piece being equipped with radial arms (38) engaged in parallel grooves (33) formed in the wall of a cylindrical housing (32), these grooves being alternately short and long, of a length limited by a stop wall limiting the displacement of the radial arms of the bearing piece in the grooves, and wherein the push-button (29) is mounted slidingly, but retained in rotation, and has one end in the form of a crown equipped with a toothing made of ratchet teeth (36) which come to bear on the radial arms (38) of the bearing piece when the push-button is pressed, in such a manner that the inclines of its teeth, by bearing on the radial arms of the bearing piece, tend to drive the bearing piece rotationally and that when said radial arms (38) escape from said grooves, the bearing piece turns by one turn and each of its arms passes from one groove to the following groove.

9. A ski boot having an internal and external side and a front and rear and comprising a lower part (1) surrounding a foot and a heel of a skier and a shaft (4,12) articulated on the lower part, said boot further comprising, at the rear, a first stop (20; 44; 50) fixedly mounted on the lower part (1) of the boot and a second stop (15; 25; 40; 50), interacting with said first stop, mounted on the shaft of the boot to hold the shaft in downhill position, inclined towards the front, the second stop being mounted movably so as to allow restraightening and oscillation of the shaft on the lower part (1) of the boot, the second movable stop (15; 25; 40; 50) is equipped with an arm (22; 28; 42; 52) passing through the shaft of the boot on the external side thereof, so as to be capable of being actuated by essentially vertical pressure exerted by a pole, wherein the movable stop (25) is articulated on the shaft (12) about a horizontal axis transverse to the boot and wherein said arm (28) is an elbowed arm articulated on the movable stop and actuable by a bistable push-button (29) holding the movable stop out of the trajectory of the fixed stop (20) in one of the movable stop's stable positions, wherein the movable stop (25) is pushed by a spring (27) in the direction of the lower part of the boot and wherein the arm (28) articulated to the movable stop is a link, the end of which bears, under the thrust of the spring, in a depression in the form of a bowl of a bearing piece (34) of the push-button (29), this bearing piece being equipped with radial arms (38) engaged in parallel grooves (33) formed in the wall of a cylindrical housing (32), these grooves being alternately short and long, of a length limited by a stop wall limiting the displacement of the radial arms of the bearing piece in the grooves, and wherein the push-button (29) is mounted slidingly, but retained in rotation, and has one end in the form of a crown equipped with a toothing made of ratchet teeth (36) which come to bear on the radial arms (38) of the bearing piece when the push-button is pressed, in such a manner that the inclines of its teeth, by bearing on the radial arms of the bearing piece, tend to drive the bearing piece rotationally and that when said radial arms (38) escape from said grooves, the bearing piece turns by one turn and each of its arms passes from one groove to the following groove.

* * * * *